United States Patent [19]

Degen

[11] Patent Number: 5,044,587

[45] Date of Patent: Sep. 3, 1991

[54] ERGONOMIC SEAT

[75] Inventor: Hugo Degen, Seltisberg, Switzerland

[73] Assignee: Marpal AG, Chur, Switzerland

[21] Appl. No.: 513,559

[22] Filed: Apr. 24, 1990

[30] Foreign Application Priority Data

Apr. 25, 1989 [CH] Switzerland ..... 1559/89

[51] Int. Cl.[5] ..... F16M 13/00

[52] U.S. Cl. ..... 248/158; 248/160; 248/624; 248/635; 108/150

[58] Field of Search ..... 108/150, 144; 248/623, 248/624, 160, 158, 621, 632, 634, 635

[56] References Cited

U.S. PATENT DOCUMENTS

| | | | |
|---|---|---|---|
| 1,610,069 | 12/1926 | Weber | 248/623 |
| 2,118,085 | 5/1938 | Helmond | 248/621 |
| 3,052,435 | 9/1962 | Roller | 248/621 X |
| 3,230,909 | 1/1966 | Watson | 248/158 X |
| 3,588,013 | 6/1971 | Mazak | 248/158 |
| 4,027,843 | 6/1977 | Thompson | 248/632 |
| 4,130,263 | 12/1978 | Roericht | 248/158 X |
| 4,792,088 | 12/1988 | Bonnell | 248/160 X |
| 4,807,841 | 2/1989 | Edstrom | 248/160 X |
| 4,858,880 | 8/1989 | Durand | 248/635 |
| 4,869,552 | 9/1989 | Tolleson et al. | 248/160 X |

FOREIGN PATENT DOCUMENTS

| | | | |
|---|---|---|---|
| 1042842 | 11/1953 | France | 248/158 |
| 1170615 | 1/1959 | France . | |
| 2460649 | 3/1981 | France | 248/623 |
| 700263 | 11/1953 | United Kingdom | 248/635 |

*Primary Examiner*—Robert L. Wolfe
*Assistant Examiner*—Suzanne L. Dino
*Attorney, Agent, or Firm*—Ralph W. Selitto, Jr.

[57] ABSTRACT

The foot bearing the seat surface of a seat is divided at a distance of 20–30 cm from the seat surface. Between the mutually facing end faces of the two foot parts (5*a*,5*b*) a rubber cushion (9) is arranged, the circumferential area of which is widened to form a brake ring (11). The elastic restoring force, working counter to the inclination of the seat, of this cushion is reinforced by two further cushions (16,17) arranged within the foot parts (5*a*,5*b*). By means of the suitable arrangement of sliding elements with low friction (T1–T3), the mutual rotation between the two foot parts (5*a*,5*b*) is ensured.

Thanks to this construction, the seat surface can be swiveled in a tumbling manner in such a way that every point of said seat surface moves on an imaginary spherical surface and thanks to the mentioned elastic restoring force, the seat part always returns automatically to its initial position. When the seat is inclined, the then undesired rotation of the upper seat part (5*a*) is prohibited by the friction between its edge area (R) and the compressed brake ring (11).

6 Claims, 2 Drawing Sheets

FIG. 1
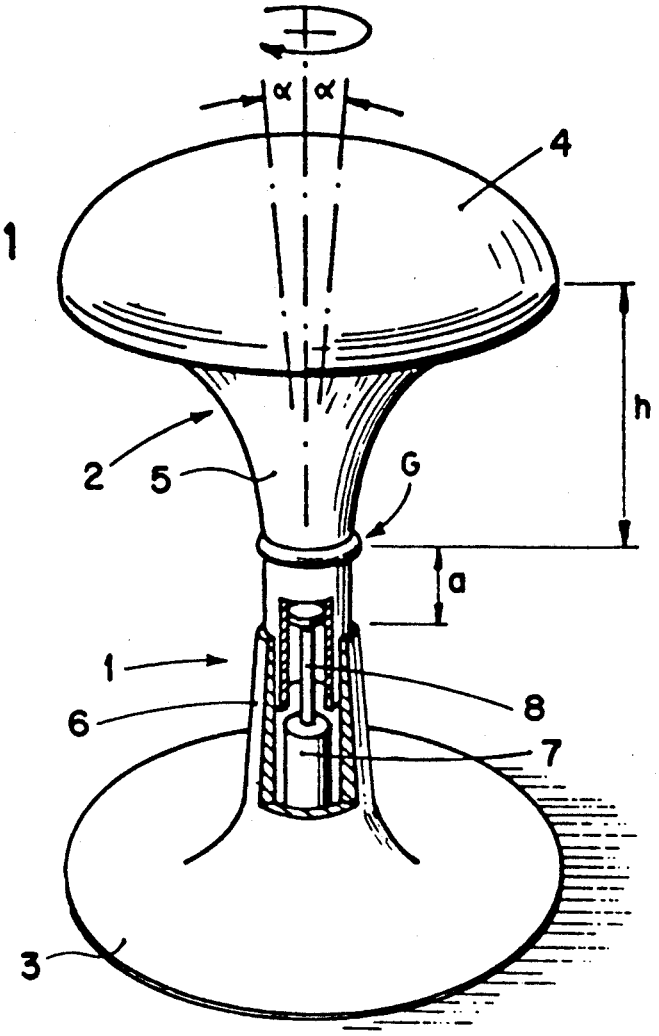
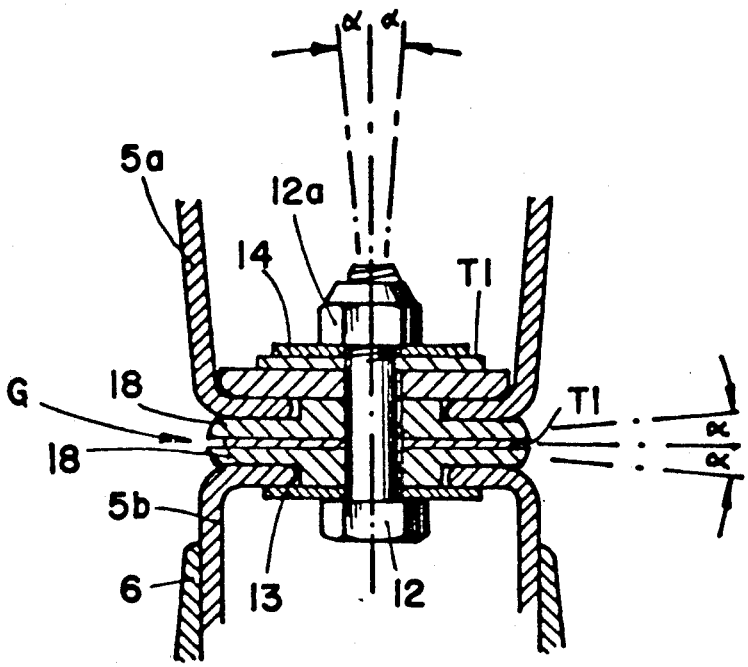
FIG. 5

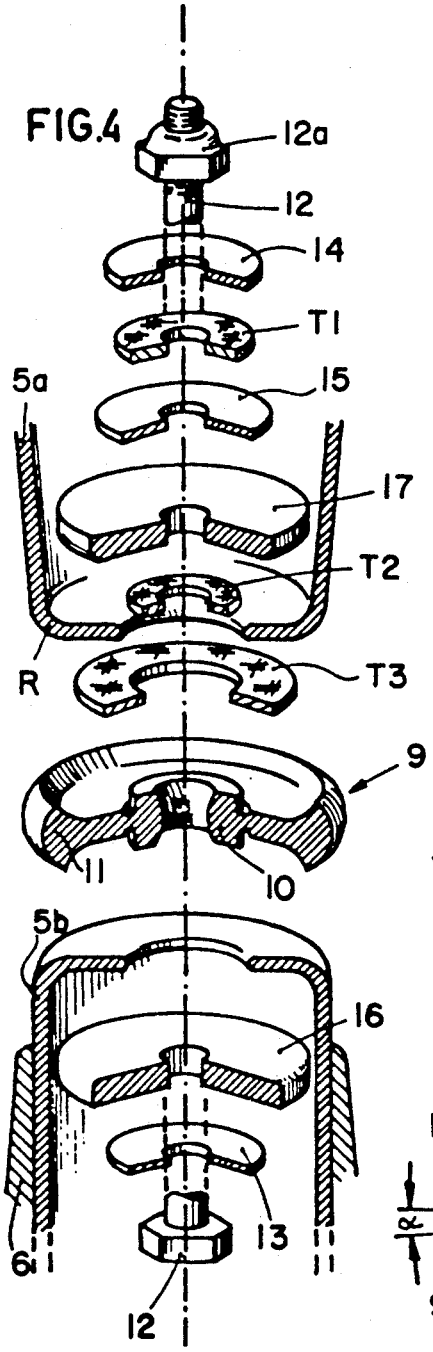
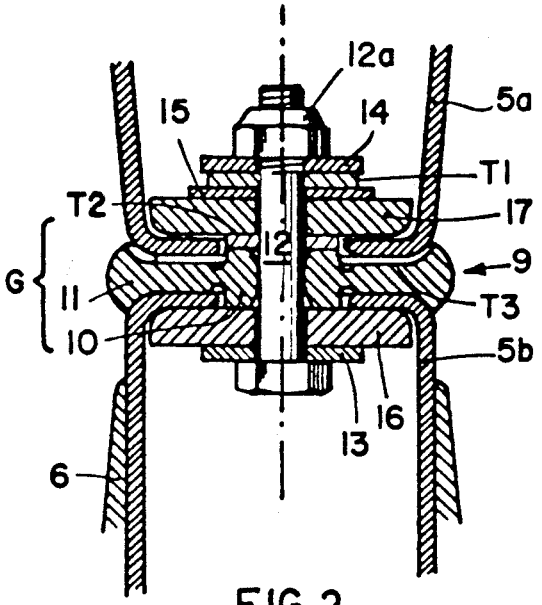
FIG. 2
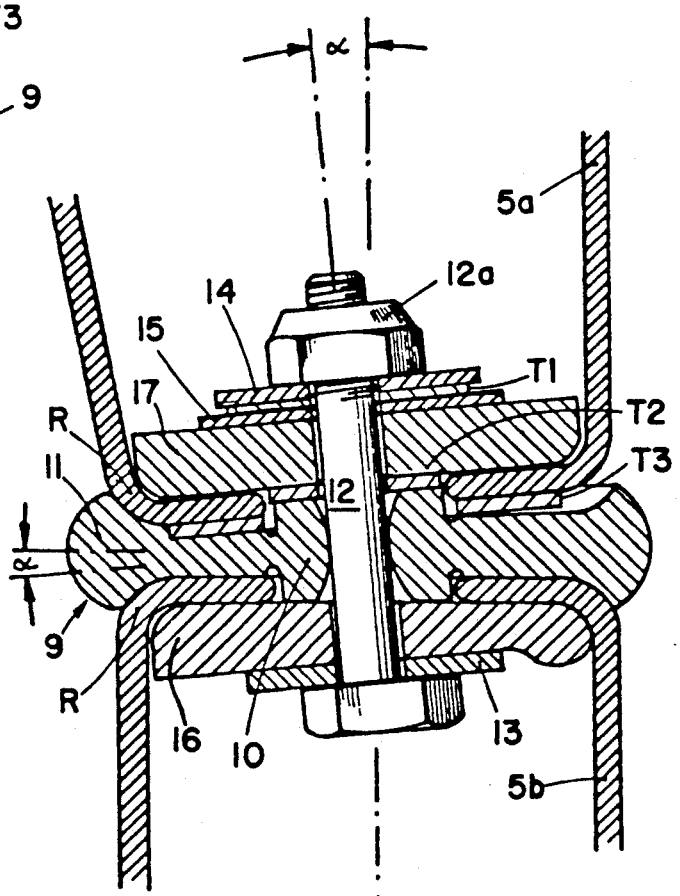
FIG. 3

ERGONOMIC SEAT

The present invention relates to a seat according to the preamble of the independent claim.

Office chairs are known, the seat of which is on the one hand rotatably mounted on a stand and on the other hand can be adjusted in one direction, i.e. in the sense of an inclination directed forwards or backwards. When sitting for a relatively long period, the known embodiments of this chair type prove to be too rigid in as far as they still accord too little significance to the anatomical conditions of the sitting body when working and its requirement for variation of the sitting position. A feature which is common to these known working chairs is, in particular, to be seen in the fact that they impose a quite specific posture on the person who is active in the sitting position, fatigue-free working over a relatively long period being impossible in said posture. In any event, these chairs do not allow for the natural requirement for a periodic correction of posture associated with a redistribution of weight French Patent Specification No. 1,170,615 shows a stool which is intended to be usable for example by dentists, and the foot of which bearing the seat part projects with its lower tapered end through a rubber block The seat part can be laterally deflected in this way and always returns again, under the influence of the elastic restoring force of the rubber block, into its initial position. By means of the arrangement of the rubber block at the lower foot end, the lever arm which is active during inclination of the seat is so long that there is the risk of tipping over, which, especially in the case of a dentist engaged with both hands in working on the patient, could be particularly unpleasant. In this arrangement, therefore, the angle of inclination of the foot must be kept within very narrow limits The stool described in U.S. Pat. No. 3,230,909 consists of two identical halves which are rigidly connected to one another by means of a coupling sheath There is no consideration here of a lateral deflection of the seat part and of the elastic restoration of said seat part; the indicated embodiment of the stool parts is rather intended to make manufacture cheaper, in particular by reducing the moulding costs and in addition, simplifying the procedure of removal from the mould.

It is the object of the present invention to propose a seat provided with a rotatably mounted seat part, said seat permitting the seated person to change his respective position in any desired direction in such a way that on the one hand a restoring force which grows with the angle of inclination corresponds to any lateral inclination and furthermore, from a specific inclination position onwards, the rotatability of the seat is preferably automatically disabled. In this respect, in a stationary chair, i.e. of non-rollable construction, the reaching range to the telephone or other objects to be grasped should be improved by means of the lateral inclination of the seat surface, whilst at the same time during the activity performed in a seated position the back and leg musculature should be exercised by means of the possibility of occasional redistributions of weight and changes of position.

The combination of features proposed for achieving this object results from the characterizing part of the independent claim, preferred embodiments forming the subject of the dependent claims.

Below, several exemplary embodiments of the subject of the invention are described with reference to the enclosed drawings.

FIG. 1 shows a simplified perspective representation of a rotatable stool constructed according to the invention, FIG. 2 shows the center section of the stool, i.e. the transition area of stand and seat part, with the vertical loading, FIG. 3 shows the same central section with inclined seat part, FIG. 4 is an exploded representation of the individual parts forming the central area, FIG. 5 is a sectional diagrammatical representation of a constructional variant and The stool represented in FIG. 1 has a stand 1 and a seat part 2 rotatably mounted on the same. The stand 1 is supported via a plate 3 on the floor and of course its design can correspond to all possible commercially available constructional types, for example even with rollers.

The seat part 2 has an upholstered seat surface 4 and projects telescopically with its cylindrical lower part 5 into the tubular, upward projecting upper part 6 of the stand 1. A lifting device 7 arranged in the stand 1 can, for example, comprise a gas spring which permits the seat part 2 to be raised or lowered as desired by means of a piston 8 (by amount a).

The described lifting device of the seat part 2 is known and can also be varied, in the scope of the present conception of the invention, in manifold ways corresponding to the commercially available embodiments.

The articulated connection, particularly to be noted in the present context, between stand 1 and seat part 2 is located in the joint area designated in FIGS. 1 and 2 by G and is now described with reference to FIGS. 2–5.

FIGS. 2–4 show a first preferred embodiment. According to these, the construction directly bearing the seat surface 4 is divided in the joint area G and has two coaxial, tubular, preferably slightly conical, hollow bodies 5*a*/5*b*, the mutually facing end faces of which being, on the one hand, bent inwards with two central openings being recessed and, on the other hand, being separated from one another by an elastic cushion 9. The cushion 9 projects with its inner, hammerhead-shaped shoulder 10 through the central openings and has at its circumferential area a ring 11, continuously extending outwards, which from now on in view of its function, still to be explained, will be designated as a brake ring 11.

A bolt 12 holds the two foot parts 5*a* and 5*b* with the interposition of washers 13,14 and 15, elastic cushions 16 and 17 and teflon plates T1,T2,T3. As is shown in FIGS. 2 and 3, the teflon plates, in each case of annular construction, are arranged such that they permit a low-friction mutual rotation of the two parts of the seat 5*a* and 5*b*. In this case, the upper teflon plate T1 is arranged between the two washers 14 and 17 in order to permit rotation of the seat upper part 5*a* in relation to the bolt 12 and the nut 12*a* connected to the latter. The second teflon plate T2 is located between the cushion shoulder 10 and the upper cushion 17 and the third teflon plate T3 is arranged between the central part of the cushion 9 and the end face, lying on top of it, of the seat upper part 5*a* in order to permit the easy mutual rotation between seat upper part 5*a* and seat lower part 5*b*.

In viewer of this arrangement of the elements constituting the central area G, the following functions are obtained:

Thanks to the division of the seat part 5 into the two seat parts 5*a* and 5*b* and the elastic connection between said parts by means of the elastic cushions 9,16 and 17, for example consisting of rubber, the seat upper part 5*a* can not only rotate in relation to the seat lower part 5*b* but also incline in any desired direction such that every point of the seat surface 4 then moves on an imaginary spherical surface, the associate center point of which being found in the joint area G, approximately in the center of the cushion 9. This tumbling movability of the seat surface 4 on all sides permits the seated person to place himself, in the course of his activity performed in the seated position, in each case into the physiologically correct position and, thanks to the tumbling movement combined with an elastic restoring force of the seat to vary his respective position as often as desired and in any desired direction, so that, As a result of this, for example manifestations of fatigue and cramp can be avoided to a large extent and the chair can serve at the same time as a practice device for the prophylactic preservation of the health of the back. Since someone who is active in a seated position is almost never completely motionless over a relatively long period of time but rather constantly carries out movements and thus redistribution of weight in the course of his seated activity, it is of particular significance in the present context that, thanks to the elastic tumbling-joint bearing, the seat part 2 automatically matches itself to every movement independently of the respective seated position.

A precondition for the effective realization of these functions is, however, that the seat surface 4 is always returned by means of the elastic restoring force of the cushions 9,16 and 17 to its rest position illustrated in FIGS. 1 and 2, as soon as the outer forces bringing about the inclination abate.

In FIG. 3, the function of the elements of the central area G is illustrated. When the seat upper part 5*a* is inclined by the angle $\alpha$, the two cushions 9 and 16, possibly also the upper cushion 17, are pressed together on one side, as a result of which the restoring force already mentioned arises. However, at the same time the cushion ring 11 is pressed together by the edge area R of the upper seat part 5*a*, which in the rest position according to FIGS. 1 and 2 has pressureless contact with the cushion ring 11, any rotation of the seat part 2 is braked by the friction existing between edge area R and ring 11.

The inventive step on which this construction is based can be varied in manifold ways within the scope of the invention defined in the independent claim. According to FIG. 5, between seat upper part 5*a* and seat lower part 5*b* a divided cushion 18 is arranged, in the central plane of which the teflon plane T4 is mounted. The other parts were designated by the reference symbols already used in FIGS. 2 and 3 and have the function described there.

The arrangement of the joint device does not have to occur in every case in the central area of the foot. The best result is achieved if the dividing plane of the foot sections is located approximately 20–30 cm, preferably approximately 25 cm, below the seat surface (distance h in FIG. 1).

In place of the mentioned teflon plates, other sliding elements can also be used, e.g. pressure-absorbing roller bearings.

I claim:

1. An ergonomic seat, comprising a stand portion supported on an underlying surface; a seat portion mounted on said stand portion and formed with a seat surface and a columnar foot projecting from said seat surface to be received by said stand portion, said columnar foot having an upper section, a lower section and a central region arranged between said upper and lower sections approximately 20–30 cm below said seat surface; and an elastic joint device positioned in said central region of said columnar foot, said elastic joint device including first mounting means for resiliently mounting said upper section of said columnar foot on said lower section of said columnar foot such that said upper section is laterally deflectable in a tumbling manner from a rest positions and such that said supper section automatically returns to said rest position after its lateral deflection therefrom, said first mounting means including at least one elastic cushion positioned in said central region, and second mounting means for rotatably mounting said upper section of said columnar foot on said lower section of said columnar foot, said second mounting means including sliding elements having anti-friction characteristics to thereby promote the rotation of said upper section relative to said lower section.

2. An ergonomic seat according to claim 1, wherein said first mounting means includes three elastic cushions of which an upper elastic cushion is positioned in said upper section of said columnar foot, a central elastic cushion is positioned in said central region, and a lower elastic cushion is positioned in said lower section of said columnar foot, and a bolt extending from said lower section of said columnar foot through each of said three elastic cushions to said upper section of said columnar foot, and wherein id second mounting means includes s sliding element having an anti-friction surface positioned to contact a side of said lower elastic cushion facing said stand portion.

3. An ergonomic seat according to claim 2, wherein said central elastic cushion includes a torus facing said bolt and bearing a sliding member such that said sliding member is on said torus facing said upper elastic cushion.

4. An ergonomic seat according to claim 3, wherein said central elastic cushion includes a peripheral edge widened to correspond with contours of said upper and lower sections of said columnar foot for forming a brake ring directly contacting said contours of said upper and lower sections such that inclination of said upper section presses said brake ring to contact said contours of said upper and lower sections for disabling rotation of said upper section relative to said lower section.

5. An ergonomic seat according to claim 1, wherein said sliding elements are sliding disks.

6. An ergonomic seat according to claim 1, wherein said sliding elements are pressure roller bearings.

* * * * *